US009557116B2

(12) United States Patent
Velte

(10) Patent No.: US 9,557,116 B2
(45) Date of Patent: Jan. 31, 2017

(54) STACKED PLATE HEAT EXCHANGER

(75) Inventor: Volker Velte, Östisheim (DE)

(73) Assignee: Mahle International GmbH (DE)

( * ) Notice: Subject to any disclaimer, the term of this patent is extended or adjusted under 35 U.S.C. 154(b) by 420 days.

(21) Appl. No.: 13/696,219

(22) PCT Filed: May 4, 2011

(86) PCT No.: PCT/EP2011/057091
§ 371 (c)(1),
(2), (4) Date: Jan. 23, 2013

(87) PCT Pub. No.: WO2011/138349
PCT Pub. Date: Nov. 10, 2011

(65) Prior Publication Data

US 2013/0126137 A1 May 23, 2013

(30) Foreign Application Priority Data

May 6, 2010 (DE) ..... 10 2010 028 660

(51) Int. Cl.
*F28D 9/00* (2006.01)
*F28D 1/03* (2006.01)
*F28F 3/08* (2006.01)

(52) U.S. Cl.
CPC ..... *F28D 9/005* (2013.01); *F28D 1/0333* (2013.01); *F28F 3/086* (2013.01)

(58) Field of Classification Search
CPC ..... F28D 1/033; F28D 7/0025; F28D 9/005; F28D 3/086
USPC ..... 165/166, 165, 167
See application file for complete search history.

(56) References Cited

U.S. PATENT DOCUMENTS

| | | | | |
|---|---|---|---|---|
| 6,170,568 | B1 * | 1/2001 | Valenzuela | 165/167 |
| 6,312,456 | B1 | 11/2001 | Kranz et al. | |
| 8,393,384 | B2 * | 3/2013 | Velte et al. | 165/167 |
| 2003/0098146 | A1 * | 5/2003 | Angermann et al. | 165/167 |
| 2005/0056412 | A1 * | 3/2005 | Reinke et al. | 165/167 |
| 2006/0026795 | A1 | 2/2006 | Tonelli | |
| 2006/0032621 | A1 * | 2/2006 | Martin et al. | 165/167 |
| 2007/0131402 | A1 * | 6/2007 | Hendrix et al. | 165/167 |

(Continued)

FOREIGN PATENT DOCUMENTS

| | | | |
|---|---|---|---|
| DE | 1908800 | A1 | 1/1970 |
| DE | 19909881 | A1 | 9/2000 |

(Continued)

OTHER PUBLICATIONS

English abstract for JP11-193998.

*Primary Examiner* — Devon Russell
(74) *Attorney, Agent, or Firm* — Fishman Stewart PLLC

(57) ABSTRACT

A stacked plate heat exchanger may include a plurality of elongated plates on top of and connected to one another. The elongated plates may define a first cavity in the longitudinal direction of the plates and be configured to cool a medium. The elongated plates may define a second cavity for conducting a coolant therethrough, wherein in two end regions of each elongated plate, a through hole may be arranged for supplying the medium to be cooled. The through hole may be at least partially surrounded at its boundary by a dome and arranged approximately at the edge of the elongated plates. At least one of the dome and the through hole may be integrated in the edge of the elongated plate.

6 Claims, 12 Drawing Sheets

(56) References Cited

U.S. PATENT DOCUMENTS

| | | | | |
|---|---|---|---|---|
| 2008/0066895 | A1* | 3/2008 | Wegner | 165/167 |
| 2008/0264618 | A1 | 10/2008 | Richter | |
| 2008/0264619 | A1 | 10/2008 | Velte et al. | |

FOREIGN PATENT DOCUMENTS

| | | | |
|---|---|---|---|
| DE | 102005034405 | A1 | 3/2006 |
| DE | 102005034305 | A1 | 1/2007 |
| DE | 102005044291 | A1 | 3/2007 |
| DE | 102006044154 | A1 | 5/2008 |
| JP | 11-193998 | A | 7/1999 |
| WO | WO-2005/057118 | A1 | 6/2005 |
| WO | WO-2009/062310 | A1 | 5/2009 |

* cited by examiner

STACKED PLATE HEAT EXCHANGER

CROSS-REFERENCE TO RELATED APPLICATIONS

This application claims priority to German Patent Application 10 2010 028 660.5, filed on May 6, 2010, and International Patent Application PCT/EP2011/057091, filed on May 4, 2011, both of which are hereby incorporated by reference in their entirety.

TECHNICAL FIELD

The invention relates to a stacked plate heat exchanger having a plurality of elongated plates which are stacked on top of each other and connected to one another, and which have a cavity through which a medium to be cooled is conducted in the longitudinal direction of the plates, and which plates delimit a further cavity for conducting a coolant therethrough, wherein approximately in the two end regions of each elongated plate, a through hole is arranged for supplying the medium to be cooled, which through hole is at least partially surrounded at its boundary by a dome.

BACKGROUND

Stacked plate heat exchangers which cool air fed to an internal combustion engine by means of oil-coolant or air cooling are well known in the cooler industry. FIG. 1 shows an elongated plate of a stacked plate heat exchanger which is cooled with oil. In the perspective view of FIG. 1*a*, the elongated plate 1 has a plate rim 2 and a plurality of circular-segment-shaped, stamped through holes 3. At least 2 of the circular-segment-shaped stamped through holes 3 are surrounded by a dome 4 (FIG. 1*b*). As can be seen from the cross-section in FIG. 1*c*, each through hole 3 has a distance 5 from the edge of the plate. This results in that the effectiveness of the heat exchanger is limited because not all regions of the elongated plate are utilized for heat transfer.

A similar arrangement is given in the case of a stacked plate heat exchanger which is cooled with air and which is illustrated in FIG. 2. Here too, the stacked plate heat exchanger consists in particular of a plurality of elongated plates 6 of which only one is shown in FIG. 2. This elongated plate 6 is completely surrounded by a plate rim 7. Each plate 6 has two through holes 8 for the medium to be cooled and, furthermore, two through holes 9 for the coolant. As is shown in FIG. 2*b*, the through hole 8 as well as the through hole 9 is surrounded by a dome 10, 11. Such a dome 10, 11 in the plates 6 is necessary so as to separate the coolant from the medium to be cooled in the heat exchanger. The described arrangement of the through holes 8 and 9 in the plate 6 results in increased material requirements and a more complex plate geometry due to a higher degree of forming with regard to the through holes 8 and 9. Also, a disadvantage here is that for the available volume to be installed only limited power for heat exchange is available.

SUMMARY

It is therefore an object of the present invention to provide a stacked plate heat exchanger with which, while maintaining a simple plate geometry, a maximum power-to-volume ratio during the heat transfer is achieved.

According to the invention, the object is achieved in that the through hole is arranged approximately at the edge of the elongated plate, wherein the dome and/or the through hole is integrated in the edge of the elongated plate. This has the advantage that no thermotechnically ineffective regions are present in the heat exchanger when using the elongated plate. Thus, the entire elongated plate is utilized for the heat exchange, which results in a compact design. Said compact design enables saving material cost and allows a simpler plate geometry.

Advantageously, the dome is arranged adjacent to a rim delimiting a base plate of the elongated plate. Thus, the available installation space is fully utilized because the heat exchange takes place over the entire surface of the elongated plate.

In one configuration, the dome is arranged in a different plane than the rim of the elongated plate, wherein said dome is preferably embossed into the base plate or is raised and protrudes from the base plate. This arrangement results in an improved stackability of the individual plates of the heat exchanger.

Advantageously, in another embodiment, the dome can completely fill a space between a rim delimiting a base plate of the plate and the respective through hole. Through this, the available installation space is optimally utilized without creating dead spaces for the medium to be cooled.

In a refinement, the through hole is arranged in a different plane than the elongated plate. This configuration too improves stackability of the elongated plates.

In one variant, the dome has a plurality of elongated holes feeding the coolant. This increases the compactness of the component because the dome is used as a spacer to the elongated plate arranged thereabove and also receives on the same surface the elongated holes for conducting the coolant therethrough.

Furthermore, the through hole is approximately circular-segment-shaped, wherein the elongated holes surrounding the through hole are curved in a circular-arc-shaped manner. Through this configuration, consumption of material is reduced and an optimal plate geometry is achieved.

In one refinement, the dome of a first elongated plate together with a further elongated plate arranged therebelow or thereabove forms an annular channel which is interrupted by the elongated holes. By using the dome for the annular channel in which the coolant is transported, material requirements for the heat exchanger can be further reduced and the design can be configured in a particularly compact manner.

In another advantageous embodiment, the base plate can lie in a first plane which lies between a second plane, in which the respective through hole lies, and a third plane in which the elongated holes lie. Thus, within a small area, a multi-step structure is obtained which is characterized by a high stiffness.

According to another advantageous embodiment, the dome can at least partially be integrated in a rim delimiting a base plate of the elongated plate. In this case, rim and dome quasi transition into each other and enable dual use of the respective wall section. This results in a particularly compact structure.

Particularly advantageous is a refinement in which an outer dome wall running along the edge of the plate is integrated in the rim. In other words, said outer wall of the dome forms an integral part of the rim when dome and rim are arranged on the same side of the plate, or forms an integral extension of the rim when dome and rim are arranged on opposite sides of the plate. This too results in a particularly compact design.

Advantageously, the dome is formed with a predetermined inclination angle which is in particular directed inward toward the through hole. Through this, stackability of the elongated plates is further improved because gaps which can occur in the solder joint of the plates lying on top of one another are prevented.

Furthermore, between a closure region of the dome and the rim, a segment is formed, the further inclination angle of which is larger than the predetermined inclination angle of the dome, wherein the deviation of the predetermined inclination angle of the dome from the further angle of the segment is approximately 5°. Through this geometry, the rim of the elongated plate has clearance in the region of the dome resulting in a circumferential soldering joint lying in one plane. Leakages within the heat exchanger are reliably prevented.

In particular, the segment is arranged at the height of the dome and ends flush with the elongated plate. This embodiment requires only a minor change in the degree of forming during the fabrication of the dome.

In another embodiment, a cam is formed on the dome at least in one closure region of the dome, which cam has approximately the predetermined inclination angle of the rim and preferably extends parallel to the dome. This cam seals a channel which is formed by using the different angles of the dome and the segment when stacking two elongated plates on top of one another.

Advantageously, the closure region of circular-arc-shaped dome is configured in a semicircular manner. Through the configuration of the closure region of the dome, said cam forms a kind of a closure in order to limit any liquid that penetrates through this channel into the heat exchanger. The cam can be kept very small in terms of its dimensions. In a refinement, said cam has an extension of less than 6 mm.

In one refinement, the dome and at least one cam are integrally formed from the elongated plate. These parts can easily be manufactured as stampings. Manufacturing is carried out in a single work step which requires only simple tools. This reduces manufacturing costs significantly.

Advantageously, the elongated plate is formed from solderable aluminum. By using this easily-formable material, manufacturing the stacked plate heat exchanger is simplified and material costs are reduced.

The invention allows different embodiments. Some of them shall be explained in more detail by means of the figures illustrated in the drawing.

DETAILED DESCRIPTION

Identical features are designated with identical reference numbers.

Figure 1:
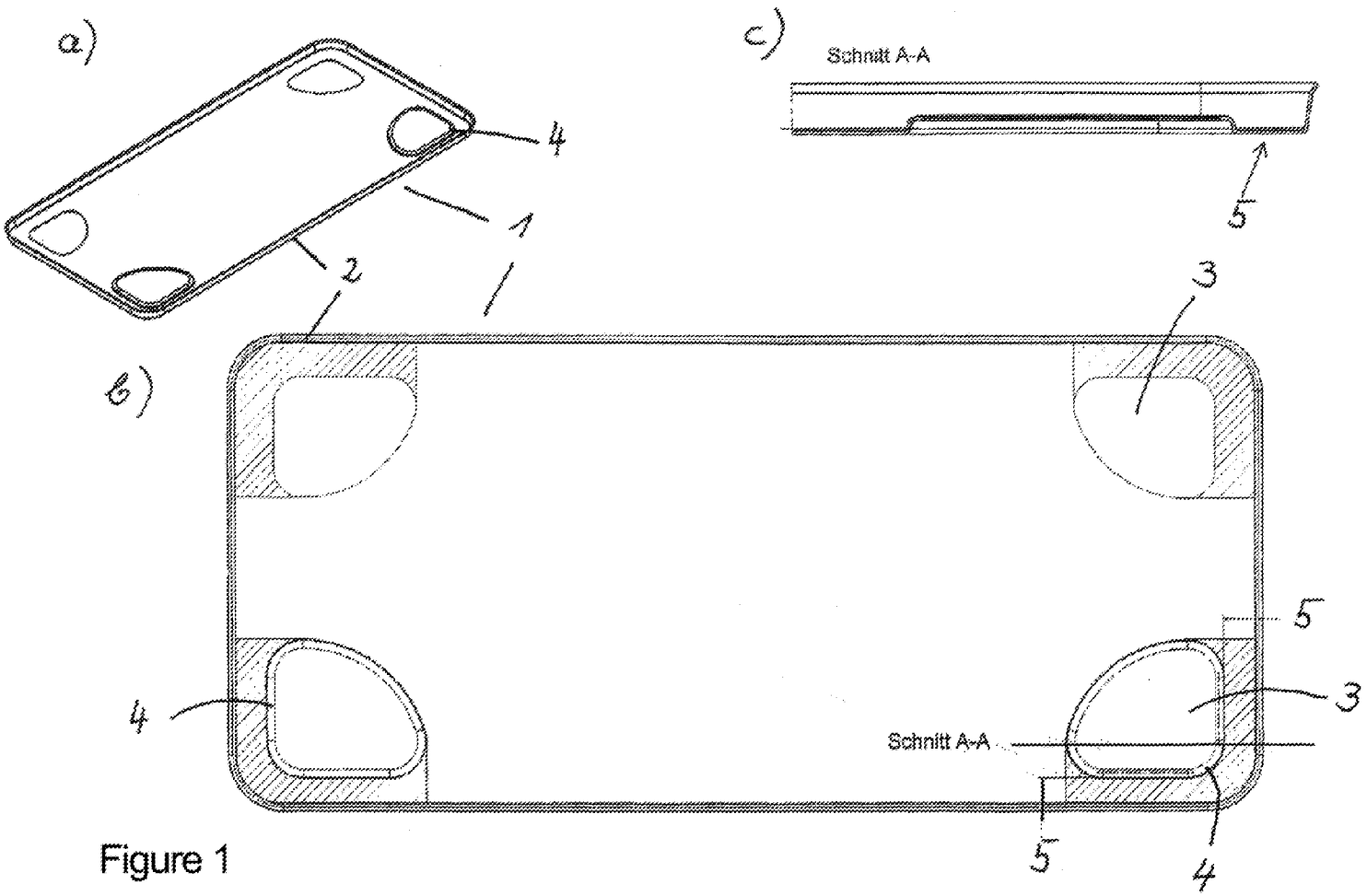
Figure 1 (Prior Art)
FIG. 1 shows an elongated plate of a stacked plate heat exchanger with oil cooling according to the prior art
Figure 2:
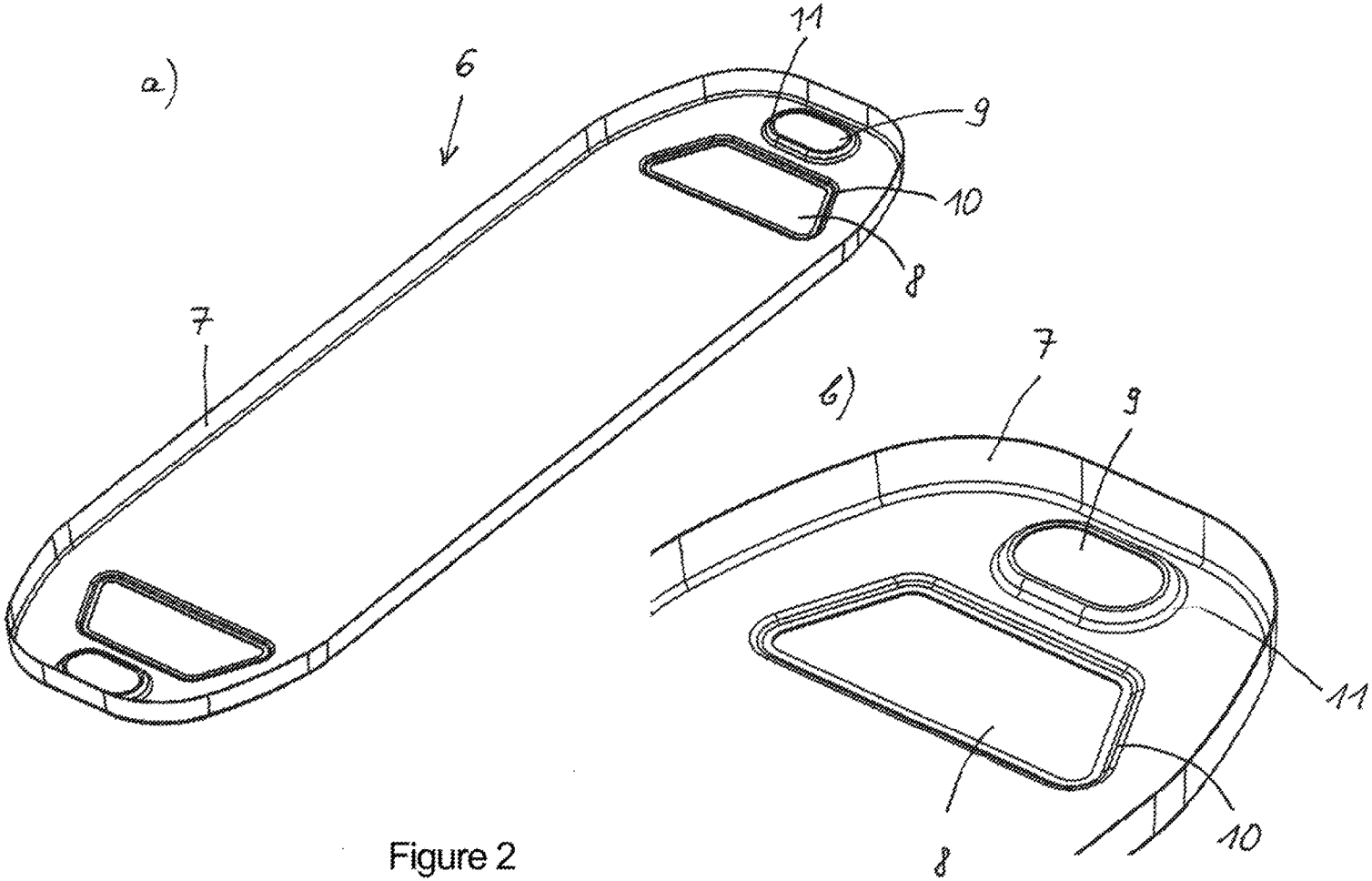
Figure 2 (Prior Art)
FIG. 2 shows an elongated plate of a stacked plate heat exchanger with air cooling according to the prior art
Figure 3:
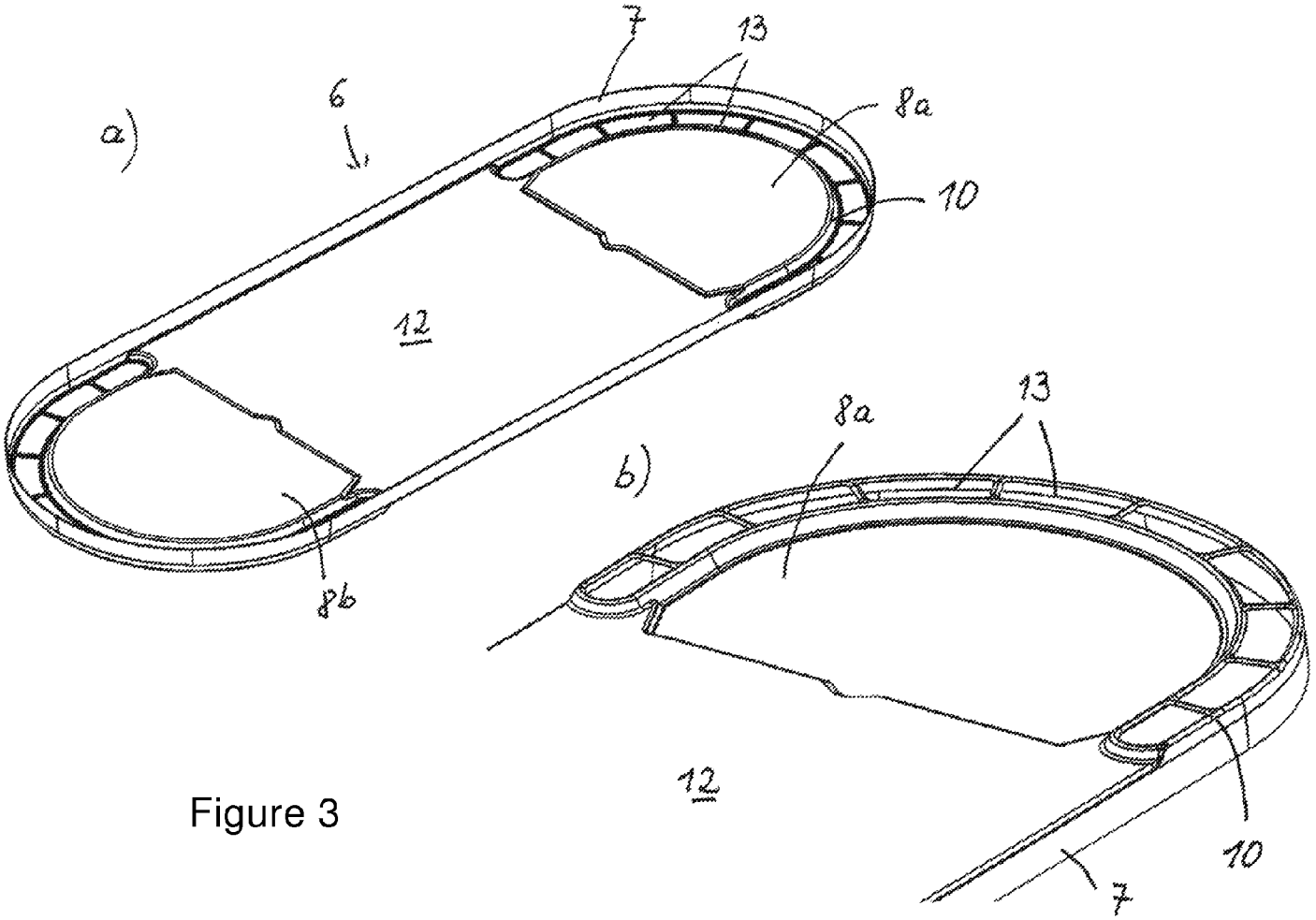
FIG. 3 shows the configuration of the dome of a heat exchanger which is cooled with air

FIG. 3 shows an elongated plate 6 of a stacked plate heat exchanger for air cooling, wherein the said plate is oval. This elongated plate 6 consists of a base plate 12 around the edge of which a boundary 7 is attached. This boundary 7 is at an angle of approximately 90° to the base plate 12 and serves for a better stacking of the different plates 6 on top of one another. On the opposite ends of the plate 6, in each case one through hole 8 is arranged which is machined out of the plate 6. Each through hole 8 is positioned so close to the edge of the boundary 7 that between the through hole 8 and the boundary 7 only a dome 10 is arranged, which is also designated as passage. Thus, this passage 10 completely fills the space between the boundary 7 and the through hole 8. The through hole 8 has a semicircular shape, wherein the radius of the semicircle is completely surrounded by the passage 10.

FIG. 3*b* shows a closer view of a through hole 8*a* with the passage 10 surrounding said hole. The passage 10 has a plurality of elongated holes 13 which fill the entire surface of the passage 10 and which face away from the base plate 12 of the elongated plate 6. Said passage is raised above the plane predetermined by the base plate 12 so that the elongated holes 13 are positioned in a plane above the plane spanned by the base plate 12.

The medium to be cooled is fed through the through hole 8*a* to the heat exchanger and is discharged again from the heat exchanger through the additional through hole 8*b* which is illustrated in FIG. 3*a*. The elongated holes 13 serve for feeding the cooling medium, in this case air, to the heat exchanger. Between the two through holes 8*a*, 8*b*, turbulence inserts are arranged which are not illustrated here and which are used for generating turbulences with the objective that the medium to be cooled flows over the entire surface of the base plate 12 and thus achieves a large heat contact with the cooling medium.

As can be seen from FIG. 3*b*, said passage 10 is stamped out from the material of the base plate 12 of the elongated plate 6 in the outward direction using a stamping process.

In the embodiment shown in the FIGS. 3*a* and 3*b*, the dome 10 or the passage 10 is at least partially integrated in the rim 7 of the plate 6, namely in the region of an outer wall of the dome 10 or the passage 10, which outer wall is not described in detail here and which extends along the edge of the plate 6. In the example of FIG. 3, the rim 7 and the outer wall of the passage 10 project from different sides of the plate 6 so that the passage 10, in the region of its outer wall, forms an integral extension of the rim 7.

Figure 4:
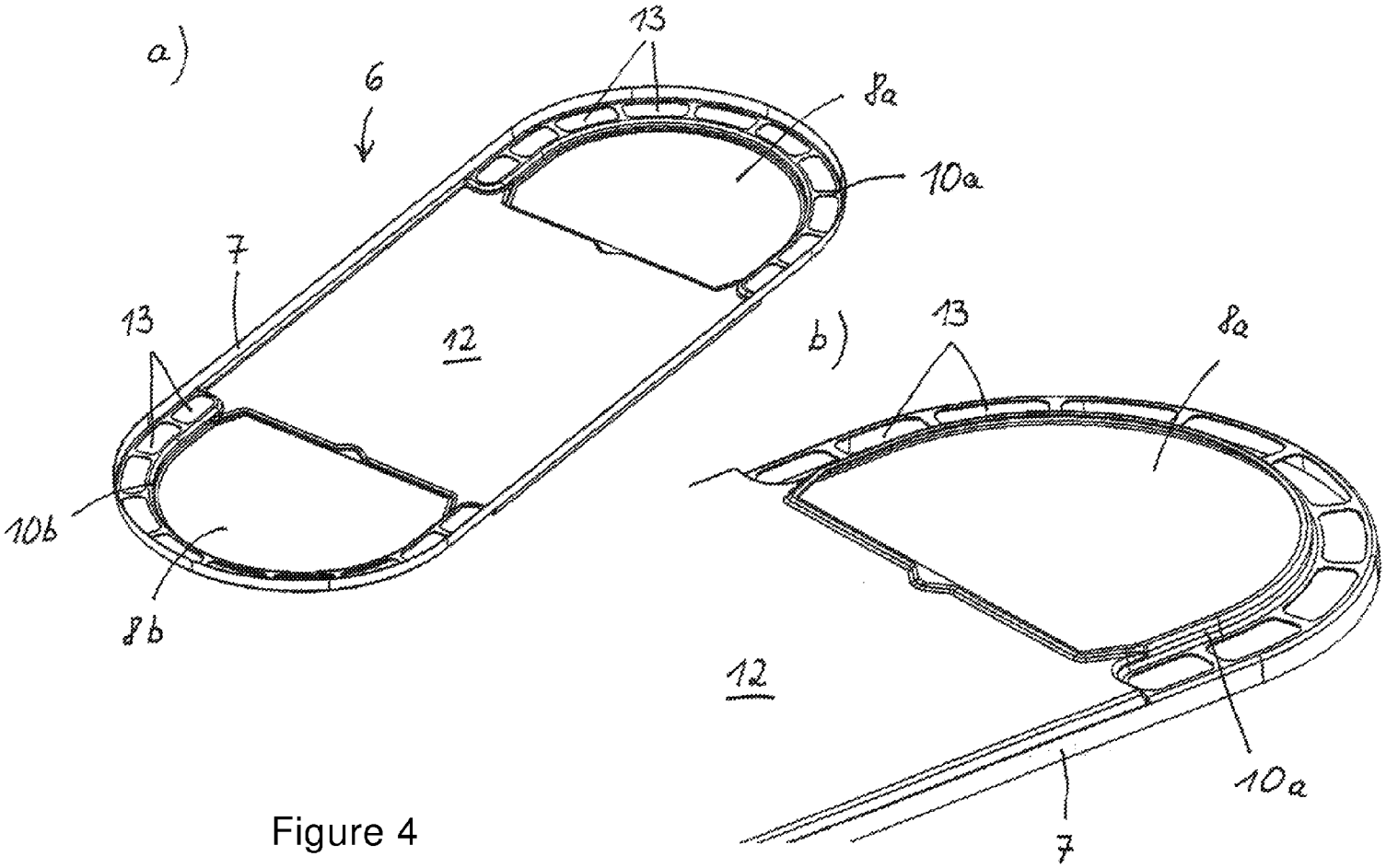
FIG. 4 shows an elongated plate of the heat exchanger according to FIG. 3 with an inwardly curved dome

FIG. 4 shows a similar arrangement of the elongated plate 6 which is used for a stacked plate heat exchanger with air cooling. The elongated plate 6 likewise consists of a base plate 12 which has an oval shape and is surrounded by a boundary 7. The two through holes 8*a*, 8*b* extending at the ends of the elongated plate 6 are in each case surrounded along their semicircle radius by a passage 10*a*, 10*b*. Here too, the passages 10*a*, 10*b* have elongated holes 13 for transporting the coolant. In contrast to FIG. 3, the passage 10*a*, 10*b* is formed inward, which means that the base plate 12 of the elongated plate 6 is formed in a higher plane than the elongated holes 13 of the passage 10*a*, 10*b*. As can be seen from FIG. 4*b*, thus, there is a step 15 between the base plate 12 and the outer edge of the surface of the passage 8*a*, 8*b*.

FIGS. 4*a* and 4*b* show in particular an embodiment in which the base plate 12 of the plate 6 lies in a first plane which is not described in detail here and which, viewed in the stacking direction, lies between a second plane, which is not described in detail here and in which the respective through hole 8*a* or 8*b* lies, and a third plane which is not described in detail here and in which the elongated holes 13 lie. This results in an extremely rigid, multi-stepped structure for the plate 6 in the region of the elongated holes 13.

Figure 5:
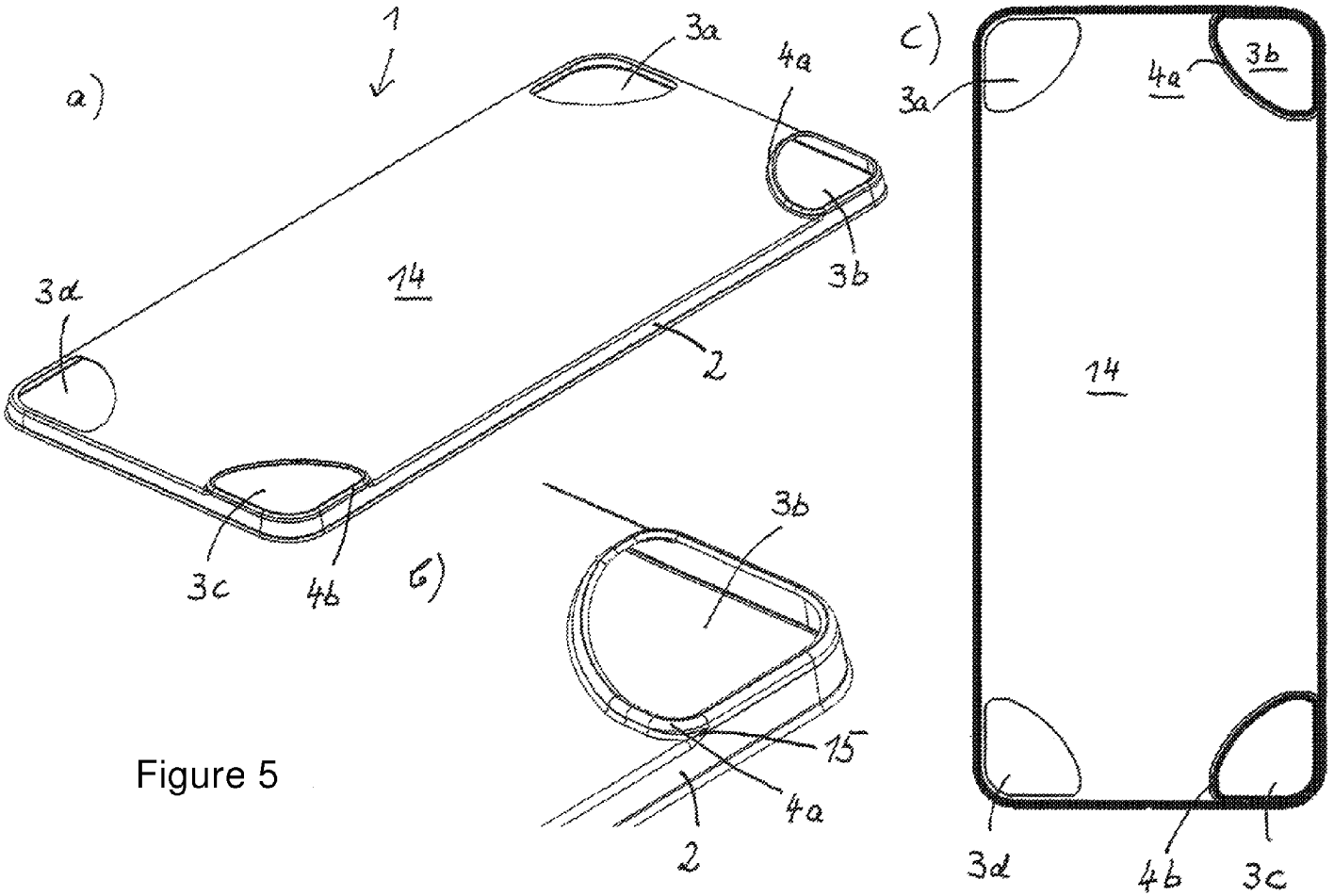
FIG. 5 shows an elongated plate of a heat exchanger with oil cooling with an outwardly curved dome
Figure 6:
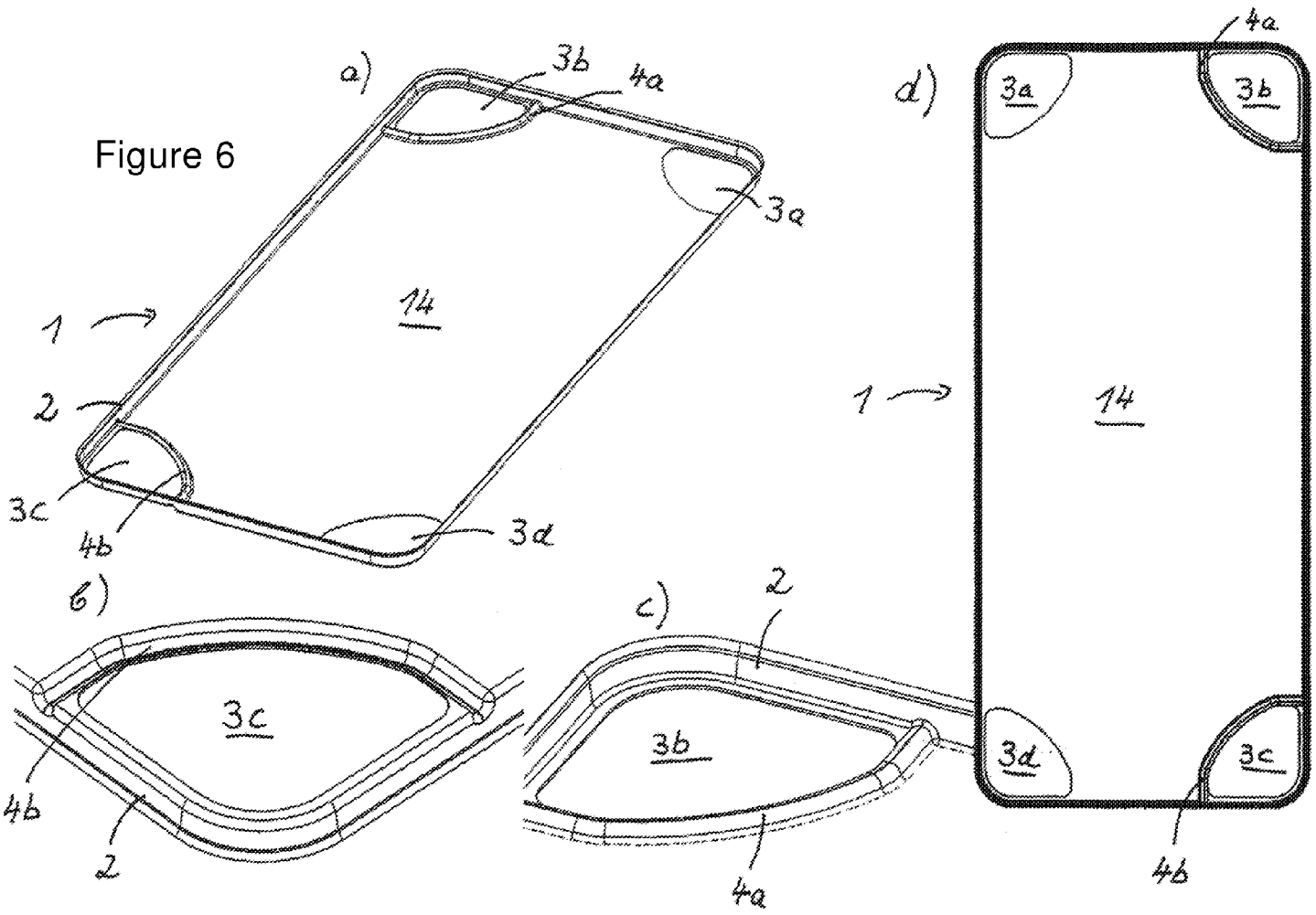
FIG. 6 shows an elongated plate of a heat exchanger with oil cooling with inwardly inclined dome

FIGS. 5 and 6 illustrate a comparable arrangement for a stacked plate heat exchanger which is cooled with oil. The elongated plate 1 is formed in a rectangle-like manner and has rounded corners, wherein this base plate 14 too is completely surrounded by a boundary 2. In the corners of the base plate 14, four through holes 3*a*-3*d* are arranged, two opposing through holes 3*b*, 3*c* of which are arranged along a longitudinal side of the base plate 14 and have in each case one passage 4*a*, 4*b* (FIG. 5*a* and 5*c*). As shown in FIG. 5*b*, there is a step 15 in that the base plate 14 leaves the normal plane and transitions with the passage 4*a* into a plane thereabove. In this embodiment, each through hole 3*a* to 3*d* extends completely into the edge region of the base plate 14 and is directly enclosed there by the boundary 2. The passage 4*a*, 4*b* completely encloses the through holes 3*b*, 3*c*, wherein a part of the passage 4*a*, 4*b* is integrated in the boundary 2.

FIG. 6 illustrates a plate 1 for the stacked plate heat exchanger with oil cooling, wherein the passage 4*a*, 4*b* is directed inward. The two passages 4*a*, 4*b* are arranged opposing each other toward the inside of the base plate 14. As illustrated in the FIGS. 6*b* and 6*c*, the plane spanned by the base plate 14 is higher than the plane in which the through hole 3*b*, 3*c* lies.

Figure 7:
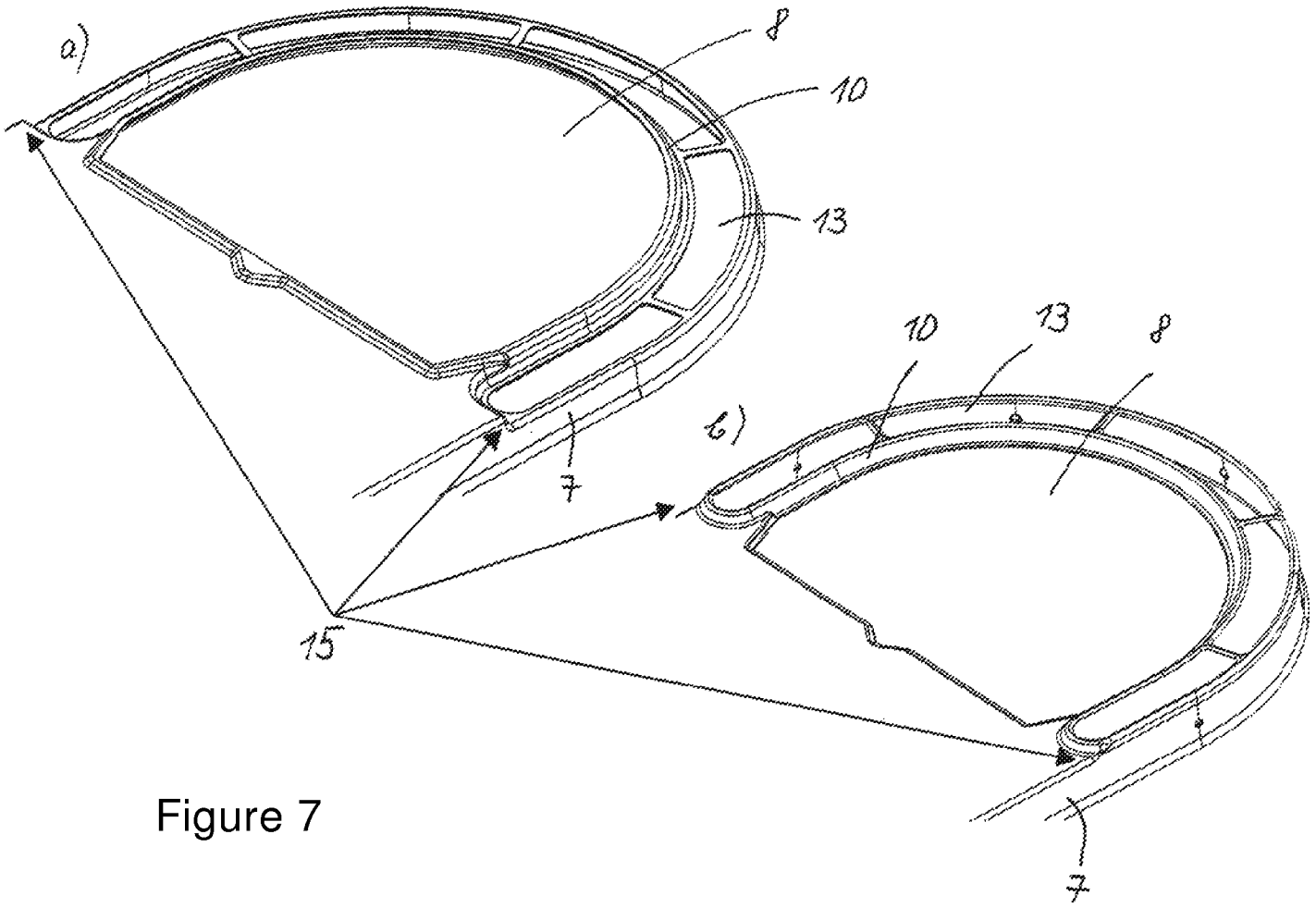
FIG. 7 shows a cut-out from the end region of an elongated plate with a step on the rim of the plate
Figure 8:
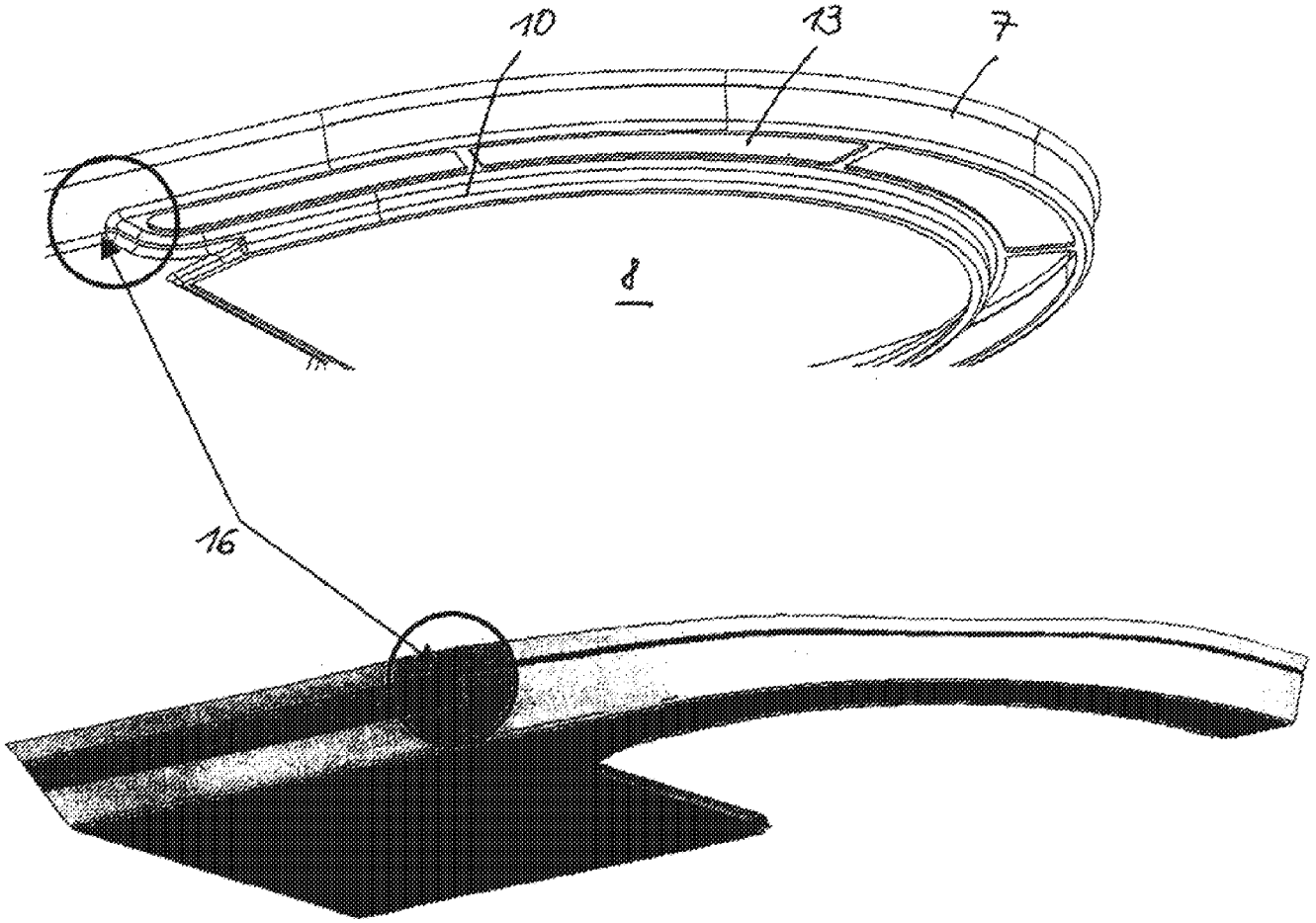
FIG. 8 shows a detailed illustration of the step according to FIG. 7
Figure 9:
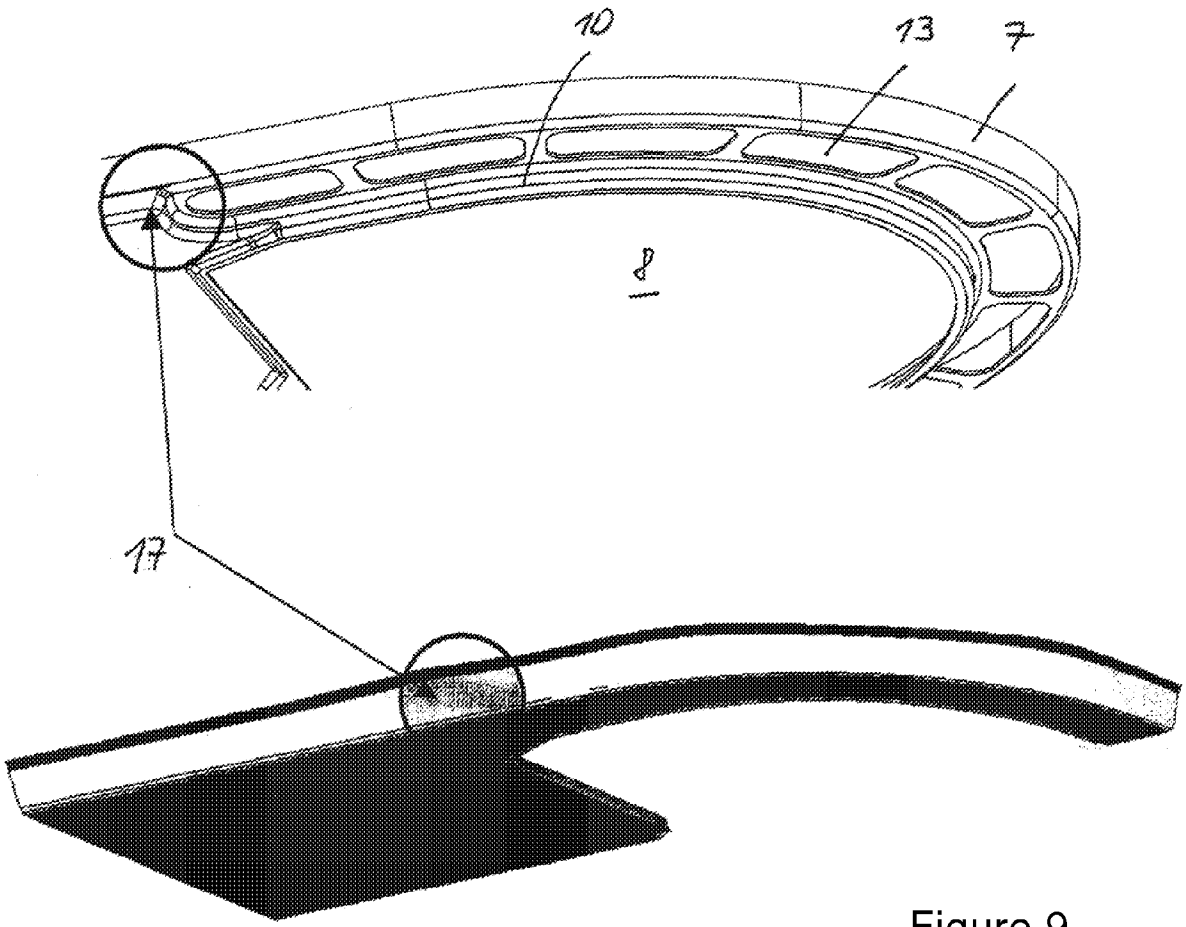
FIG. 9 shows an illustration of a segment arranged on the dome

FIG. 7 illustrates cut-outs from the elongated plate 6 of the stacked plate heat exchanger which is cooled with air. FIG. 7*a* shows an inwardly embossed passage 10 while FIG. 7*b* illustrates an outwardly extending passage 10. It is apparent from the marked regions that a step 15 between the boundary 7 of the base plate 12 and the passage 10 occurs in each case at the point where the base plate 12 transitions into the passage 8. As illustrated in FIG. 8, such a step 15 involves the problem that a gap 16 occurs when soldering a plurality of plates 6 lying on top of one another. This gap 16 is clearly visible in particular in FIG. 8. In order to prevent such a gap 16 in the soldering joint and to configure the stacked plate heat exchanger in a particularly tightly sealed manner, a segment 17 with an angle which is approximately 5° steeper than the angle at which the passage 10 is inclined toward the elongated holes 13 is inserted at the height of the transition of the passage 10 into the base plate 12. Through this clearance of the surface in the inward direction to the base plate 12, optimal soldering of two plates 6 lying on top of one another is achieved because in this manner, a circumferential contact between the soldering surface and the plate 6 is obtained. The direct contact is uniform everywhere (FIG. 9).

Figure 10:
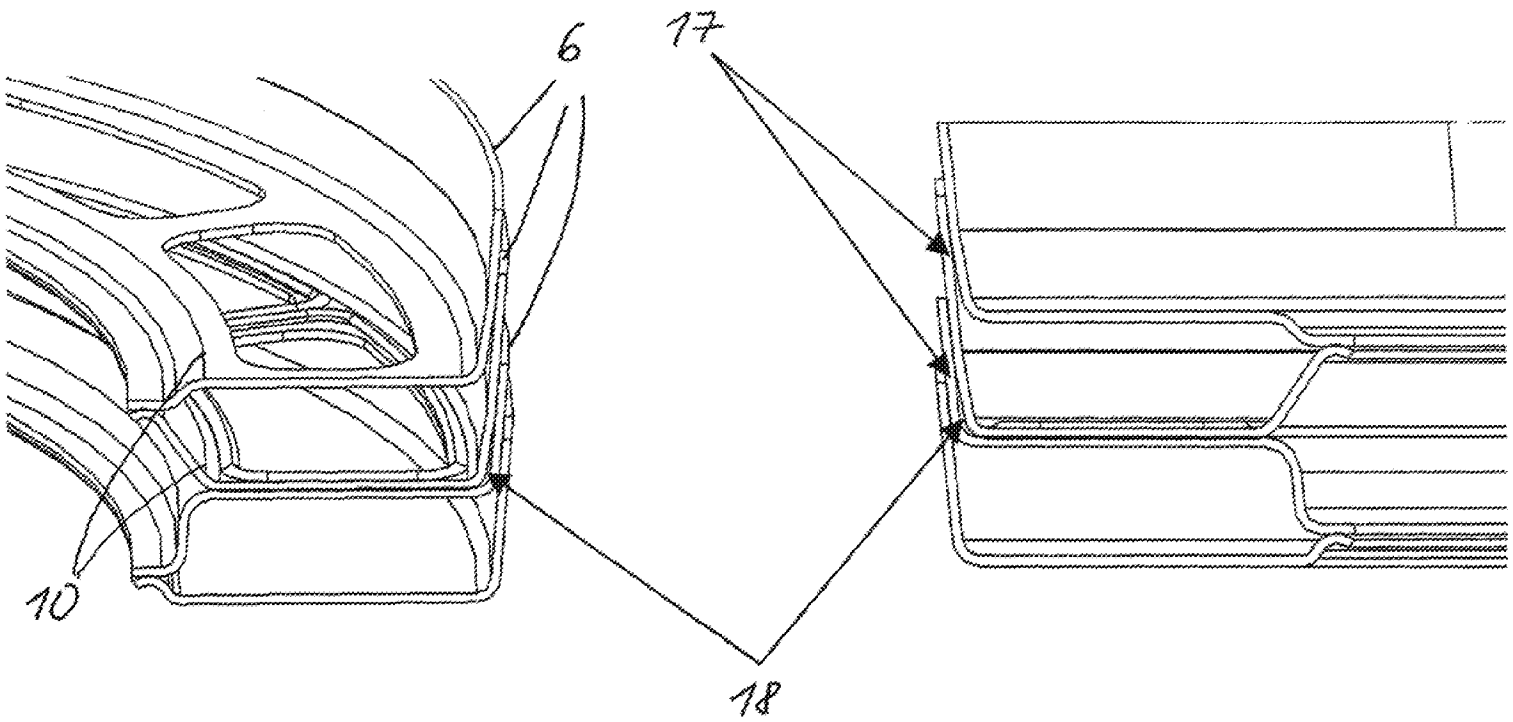
FIG. 10 shows a cross-section through a heat exchanger with the step according to FIG. 9

The circumferential direct contact of the plate 6 with the soldering surface is illustrated again in FIG. 10 for a stacked plate heat exchanger with a plurality of plates 6 lying on top of one another. Here, a circumferential channel 18 is created between two plates 6 lying on top of one another. In order to seal this circumferential channel 18 and to prevent coolant from leaking from said channel 18, a cam 19 is placed in the radius region of the semicircular passage 10, in particular near the two ends of a passage 10. Said cam 19 is located at the outer edge of the last elongated hole 13 of the passage 10, wherein the cam 19 is at an angle perpendicular to the base plate 12, which angle is larger than the angle of the outside of passage 10 to the base plate 12. Said cam 19 is approximately 5 mm wide and is arranged approximately at the radial end of the wall of the passage 10 near the segment 17 (see FIGS. 11*a* and *b*).

Figure 11:
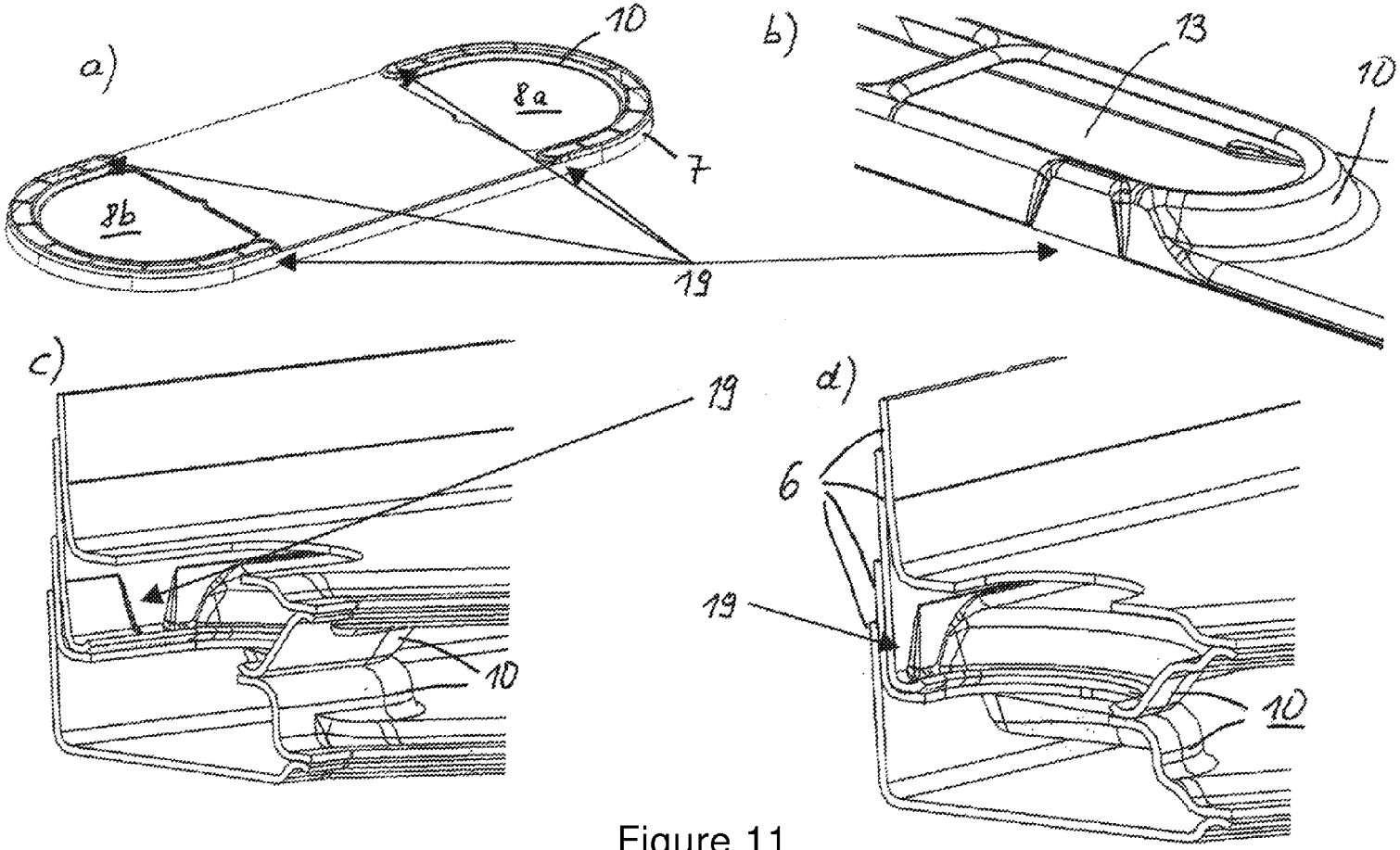
FIG. 11 shows an illustration of a cam in the radius region of the dome

FIGS. 11*c* and 11*d* show the arrangement of the cam 19 in a section through a plurality of plates 6 of the stacked plate heat exchanger stacked on top of one another. The cam 19 is positioned in the region of the boundary 7 of the elongated plate 6 and is at an obtuse angle thereto. When placing the plates 6 on top of one another, said plates are positioned such that the passages 10 of in each case two adjoining plates 6 lie on top of one another.

Figure 12:
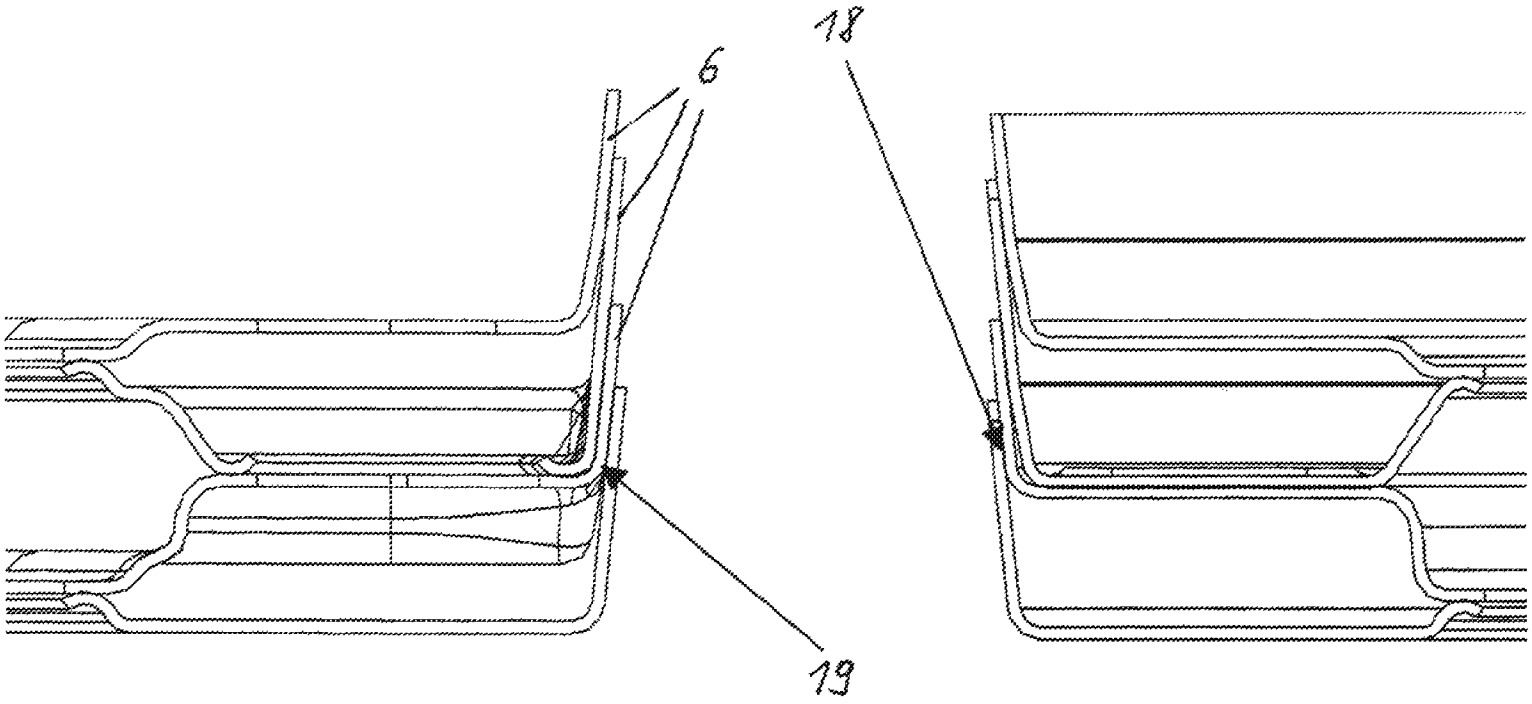
FIG. 12 shows a cross-section through the heat exchanger with the cam according to FIG. 11.

FIG. 12 also illustrates plates 6 of the stacked plate heat exchanger stacked on top of one another in a cross-section. The second angle of 5°, which is determined by the segment 17, leads to a circumferential channel 18 (FIG. 12) which is completely sealed by the cam 19 (FIG. 12).

The individual elongated plates 1, 6 of the stacked plate heat exchanger are made from a solderable aluminum and form with the described embodiments a compact heat exchanger which has a high power-to-volume ratio resulting in a maximum degree of heat transfer between the medium to be cooled and the coolant. The compact configuration of the heat exchanger results in a reduction of material consumption during the production. Moreover, a lower forming degree is required which leads to a cost-effective solution. A reliable soldering process due to a circumferential soldering surface is possible without steps so that a tightly sealed heat exchanger is generated.

The invention claimed is:

1. A stacked plate heat exchanger, comprising:

a plurality of elongated plates stacked on top of and connected to one another, with pairs of adjacent elongated plates each defining a single cavity in a longitudinal direction between base plates of each pair of the elongated plates, wherein in each of two end regions of each elongated plate a through hole is arranged for passing a medium to be cooled into the single cavity, each through hole being at least partially surrounded at its perimeter by a respective dome, wherein each respective dome abuts an edge of the respective elongated plate, said edge being defined by a meeting of a rim and a respective base plate, wherein each base plate extends between the two end regions of each respective elongated plate;

wherein each respective dome extends along a space between the respective rim and the perimeter of the respective through hole, and each dome abuts directly with a dome of a neighboring plate, and contacts the dome of the neighboring plate over;

wherein each dome includes radially extending structures that separate a plurality of holes that define each perimeter, and the plurality of holes supply a coolant and fill the space between the respective perimeter and the respective rim;

wherein each base plate lies in a respective first plane, each through hole lies in a respective second plane, the plurality of holes in each dome lie in a respective third plane, the respective first plane is between the respective second plane and the respective third plane, and the domes abut one another at their rims.

2. The stacked plate heat exchanger according to claim 1, wherein each dome is at least one of embossed into the respective base plate or raised and protruding from the respective base plate.

3. The stacked plate heat exchanger according to claim 1, wherein each pair of the plurality of elongated plates includes a first elongated plate and a second elongated plate, wherein each through hole is approximately circular-segment-shaped, and the plurality of holes surrounding the through hole are curved in a circular-arc-shaped manner, and further wherein the dome of the first elongated plate together with the second elongated plate arranged therebelow forms an annular channel.

4. The stacked plate heat exchanger according to claim 1, wherein the elongated plates are formed from solderable aluminum.

5. A stacked plate heat exchanger, comprising:

a plurality of elongated plates stacked on top of and connected to one another, with pairs of adjacent elongated plates each defining a respective cavity in a longitudinal direction between base plates of each pair of the plates;

a through hole arranged in each of two end regions of each elongated plate for supplying a medium to be cooled to the cavity, the respective through holes being at least partially surrounded at a perimeter by a respective dome, each of the respective domes abuts an edge of the associated elongated plate, said edge being defined by a meeting of a rim and a respective base plate;

wherein each base plate extends between the two end regions of each respective elongated plate;

wherein each respective dome extends along a space between the rim of the respective elongated plates and a perimeter of its respective through hole, each dome defining a plurality of elongated holes which supply the coolant, wherein the dome includes an outer wall running along the respective rim of at least one of the plates, and the dome abuts directly against a dome of a neighboring plate, and contacts the dome of the neighboring plate over the perimeter;

wherein each dome includes ribs that separate the respective plurality of elongated holes, and the holes fill a space between the respective perimeter and the respective rim; and wherein each base plate lies in a respective first plane, each through hole lies in a respective second plane, the plurality of elongated holes in each dome lie in a respective third plane, the first plane is between the second plane and the third plane, and the domes abut one another at their rims.

6. The stacked plate heat exchanger according to claim 5, wherein each dome is at least one of embossed into the respective base plate or raised and protruding from the base plate.

* * * * *